US009055657B2

(12) United States Patent
Hori et al.

(10) Patent No.: US 9,055,657 B2
(45) Date of Patent: Jun. 9, 2015

(54) EXTREME ULTRAVIOLET LIGHT GENERATION BY POLARIZED LASER BEAM

(71) Applicant: Gigaphoton Inc., Tochigi (JP)

(72) Inventors: Tsukasa Hori, Tochigi (JP); Junichi Fujimoto, Tochigi (JP); Osamu Wakabayashi, Tochigi (JP)

(73) Assignee: GIGAPHOTON INC., Tochigi (JP)

( * ) Notice: Subject to any disclaimer, the term of this patent is extended or adjusted under 35 U.S.C. 154(b) by 80 days.

(21) Appl. No.: 13/904,117

(22) Filed: May 29, 2013

(65) Prior Publication Data

US 2013/0320232 A1 Dec. 5, 2013

(30) Foreign Application Priority Data

May 31, 2012 (JP) ..... 2012-124277

(51) Int. Cl.
*H05G 2/00* (2006.01)
*G21K 5/04* (2006.01)

(52) U.S. Cl.
CPC ..... *H05G 2/008* (2013.01); *G21K 5/04* (2013.01); *H05G 2/005* (2013.01); *H05G 2/006* (2013.01)

(58) Field of Classification Search
CPC ..... H05G 2/003; H05G 2/005; H05G 2/008; H05G 2/006; G03F 7/70033
USPC ..... 250/504 R; 315/111.21; 313/231.31
See application file for complete search history.

(56) References Cited

U.S. PATENT DOCUMENTS

| | | | | |
|---|---|---|---|---|
| 5,876,195 | A * | 3/1999 | Early | 431/11 |
| 6,588,340 | B2 * | 7/2003 | Friedman | 101/467 |
| 7,897,947 | B2 | 3/2011 | Vaschenko | |
| 2002/0044629 | A1 * | 4/2002 | Hertz et al. | 378/119 |
| 2008/0149862 | A1 * | 6/2008 | Hansson et al. | 250/504 R |
| 2009/0314967 | A1 * | 12/2009 | Moriya et al. | 250/504 R |
| 2010/0117009 | A1 * | 5/2010 | Moriya et al. | 250/504 R |
| 2010/0182579 | A1 * | 7/2010 | Loopstra et al. | 250/493.1 |
| 2010/0225895 | A1 * | 9/2010 | Tanitsu et al. | 355/71 |
| 2010/0294953 | A1 | 11/2010 | Vaschenko et al. | |
| 2011/0101863 | A1 * | 5/2011 | Komori et al. | 315/111.41 |
| 2013/0015373 | A1 * | 1/2013 | Yakunin et al. | 250/492.1 |

FOREIGN PATENT DOCUMENTS

JP 2005-276671 10/2005

* cited by examiner

*Primary Examiner* — Brooke Purinton
(74) *Attorney, Agent, or Firm* — Kratz, Quintos & Hanson, LLP

(57) ABSTRACT

An extreme ultraviolet light generation apparatus may include a droplet production device configured to produce a droplet of a target substance in a predetermined traveling direction, a first laser device configured to generate a first laser beam and irradiate the droplet with the first laser beam to diffuse the droplet, a second laser device configured to generate a second laser beam and irradiate the target substance diffused by irradiation of the first laser beam with the second laser beam to produce plasma of the diffused target substance and generate extreme ultraviolet light from the plasma of the target substance, and a beam shaping unit configured to elongate a beam spot of the first laser beam in the traveling direction of the droplet produced by the droplet production device.

8 Claims, 18 Drawing Sheets

| | | |
|---|---|---|
| NOZZLE DIAMETER d (μm) | 10 | 3 |
| DROPLET DIAMETER D (μm) | 20 | 5.7 |
| DROPLET CENTER DISTANCE λ (μm) | 45 | 14 |
| NUMBER OF DROPLETS WITH A DIAMETER OF 300μm OR LESS | 7 | 23 |

EXTREME ULTRAVIOLET LIGHT GENERATION BY POLARIZED LASER BEAM

CROSS-REFERENCE TO A RELATED APPLICATION(S)

The present application claims priority from Japanese Patent Application No. 2012-124277 filed May 31, 2012, the entire contents of which are hereby incorporated by reference.

BACKGROUND

1. Technical Field

The present disclosure relates to an apparatus for generating extreme ultraviolet (EUV) light and a method for the same.

2. Related Art

A lithography apparatus used for fabrication of an integrated circuit or the like is an apparatus for transferring a desired pattern onto a substrate. A patterning device called a mask or a reticle is used for producing a circuit pattern on a substrate. Transfer of such a pattern onto the substrate is attained by imaging on a radiation-sensitive material (resist) layer provided on the substrate (for example, a silicon wafer substrate).

A critical dimension (CD) that is a theoretically predicted limit value of pattern transfer is given by the following formula (1).

$$CD=K1\cdot\lambda/NA \quad (1)$$

Here, $\lambda$ is a wavelength of light for light exposure used for pattern transfer, NA is a numerical aperture of a projection system used for the pattern transfer, and K1 is a process-dependent coefficient called a Rayleigh constant. CD is a critical dimension of a print. As can be seen from formula (1), a decrease of a transferable size can be achieved by any of the three, that is, a decrease of the wavelength $\lambda$ of light for light exposure, an increase of the numerical aperture NA, or a decrease of the K1 value.

It has been proposed that an apparatus for generating EUV light with a wavelength in a range of 10 nm to 20 nm, preferably, in a range of 13 nm to 14 nm, is used in order to reduce a wavelength of light for light exposure and thereby reduce a transferable size. For a typical EUV light generation apparatus, there can be provided a laser produced plasma (LPP) type EUV light generation apparatus, a discharge plasma type EUV light generation apparatus, an electron storage ring generated synchrotron radiation type EUV light generation apparatus, or the like.

Typically, a tin (Sn) droplet is irradiated with a laser light beam to produce plasma and thereby generate light with a wavelength in a range of EUV in an LPP type EUV light generation apparatus. Such a laser beam may be supplied by, for example, a $CO_2$ laser apparatus.

SUMMARY

An extreme ultraviolet light generation apparatus may include a droplet production device, a first laser device, a second laser device, and a beam shaping unit. The droplet production device may be configured to produce a droplet of a target substance. The first laser device may be configured to generate a first laser beam and irradiate the droplet with the first laser beam to diffuse the target substance. The second laser device may be configured to generate a second laser beam and irradiate the target substance diffused by irradiation of the first laser beam with the second laser beam to produce plasma of the target substance and generate extreme ultraviolet light from the target substance. The beam shaping unit may be configured to elongate a beam spot of the first laser beam in a traveling direction of the droplet produced by the droplet production device.

An extreme ultraviolet light generation apparatus may include a droplet production device, a first laser device, and a second laser device. The droplet production device may be configured to produce a droplet of a target substance. The first laser device may be configured to generate a plurality of first laser beams and irradiate the droplet with the first laser beams to diffuse the target substance. The second laser device may be configured to generate a second laser beam and irradiate the target substance diffused by irradiation of the first laser beams with the second laser beam to produce plasma of the target substance and generate extreme ultraviolet light from the target substance. Beam spots of the plurality of first lease beams may be located in the traveling direction of the droplet.

An extreme ultraviolet light generation method may include producing a droplet of a target substance, generating a first laser beam, shaping a beam spot of the first laser beam to be elongated in a traveling direction of the droplet, irradiating the target substance with the first laser beam to diffuse the target substance, generating a second laser beam, and irradiating the target substance diffused by irradiation of the first laser beam with the second laser beam to produce plasma of the target substance and generate extreme ultraviolet light from the target substance.

An extreme ultraviolet light generation method may include producing a droplet of a target substance, generating a plurality of first laser beams, irradiating the droplets with the first laser beams with each of beam spots of the first laser beams being located in a traveling direction of the droplets, generating a second laser beam, and irradiating the target substance diffused by irradiation of the first laser beams with the second laser beam to produce plasma of the target substance and generate extreme ultraviolet light from the target substance.

BRIEF DESCRIPTION OF THE DRAWINGS

Hereinafter, selected embodiments of the present disclosure will be described with reference to the accompanying drawings.

DETAILED DESCRIPTION

Figure 1:
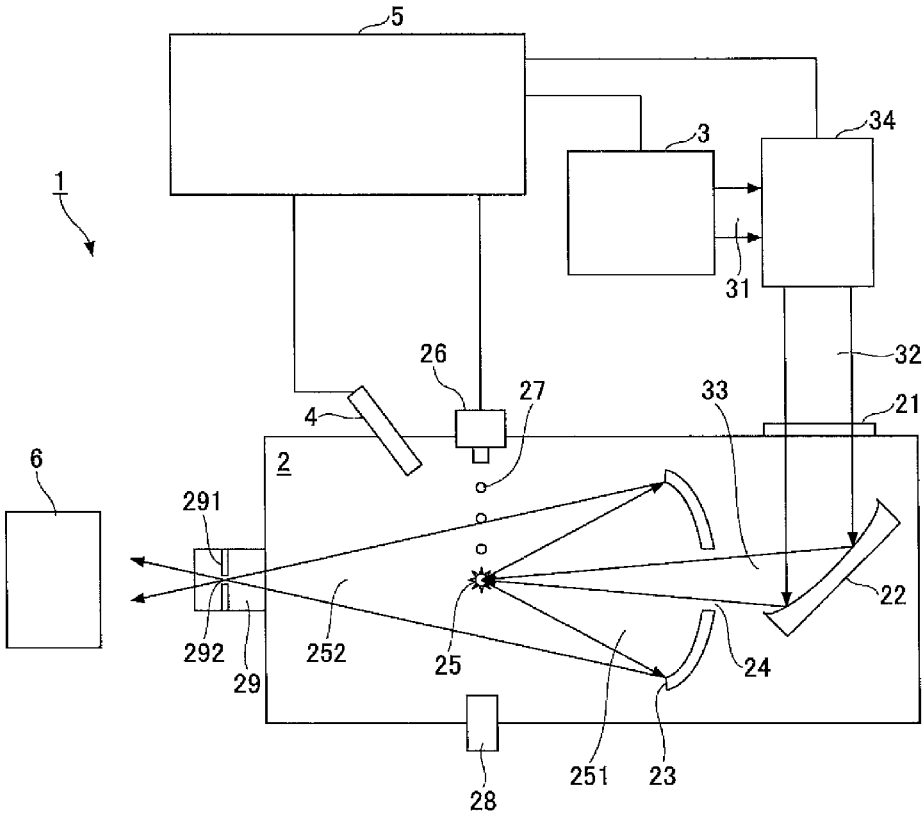
FIG. 1 is a diagram illustrating an illustrative laser produced plasma type EUV light generation apparatus according to one aspect of the present disclosure.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

Contents

1. Overview of EUV light generation apparatus
1.1 Configuration
1.2 Operation
2. EUV light generation apparatus including pre-pulsed laser device
2.1 Configuration
2.2 Operation
2.3 Effect
2.4 Target production device based on continuous jet method
2.5 Beam shaping unit for pre-pulsed laser light
3. Other embodiments of a beam shaping unit for pre-pulsed laser light
3.1 Beam shaping unit for producing a plurality of beams
3.2 Beam shaping unit for producing sheet beam
4. Embodiments of irradiation with a plurality of pre-pulsed laser light
5. EUV light generation apparatus including polarization adjustment unit
6. Embodiments of beam shaping unit for main pulsed laser light

1. Overview of EUV Light Generation Apparatus

1.1 Configuration

FIG. 1 illustrates a general structure of an illustrative laser produced plasma type EUV light generation apparatus (that will be referred to as an LPP type EUV light generation apparatus, below) 1 according to one aspect of the present disclosure. The LPP type EUV light generation apparatus 1 may be used together with at least one laser device 3 (a system including the LPP type EUV light generation apparatus 1 and the laser device 3 will be referred to as an EUV light generation system, below). As is illustrated in FIG. 1 and will be described in detail below, the LPP type EUV light generation apparatus 1 may include a chamber 2. The inside of the chamber 2 is preferably in vacuum. Alternatively, a gas with a higher transmittance for EUV light may be present inside the chamber 2. The LPP type EUV light generation apparatus 1 may further include a target supply system (for example, a droplet generator 26). The target supply system may be attached to, for example, a wall of the chamber 2. The target supply system may include tin, lithium, xenon, or any combination thereof, as a target material, but the target material is not limited thereto.

The chamber 2 may be provided with at least one through-hole that penetrates through a wall thereof. The through-hole may be sealed with a window 21. An EUV light focusing mirror 23 having a reflection surface with, for example, a shape of rotationally elliptical surface, may be arranged inside the chamber 2. The mirror with a shape of rotationally elliptical surface may have a primary focal point and a secondary focal point. A multilayer reflective coating provided by laminating, for example, molybdenum and silicon alternately may be formed on a surface of the EUV light focusing mirror 23. It is preferable for the EUV light focusing mirror 23 to be arranged in such a manner that, for example, the primary focal point is located at or near a plasma generation position (plasma generation site 25) and the secondary focal point is located at a position of a focal point (intermediate focal point (IF) 292) of EUV light reflected by the EUV focusing mirror 23. The through-hole 24 may be provided at a central portion of the EUV light focusing mirror 23 and pulsed laser light 33 may pass through the through-hole 24.

As further referring to FIG. 1, the LPP type EUV light generation apparatus 1 may include an EUV light generation control system 5. The LPP type EUV light generation apparatus 1 may include a target imaging device 4.

The LPP type EUV light generation apparatus 1 may include a communicating tube 29 for communicating an inside of the chamber 2 with the inside of a light exposure apparatus 6. A wall 291 with an aperture may be included inside the communicating tube 29 and the wall 291 may be placed in such a manner that the aperture is present at a position of the secondary focal point.

The LPP type EUV light generation apparatus 1 may include a laser light traveling direction control actuator 34, a laser light focusing mirror 22, a target recovery unit 28 for droplets 27, and the like.

1.2 Operation

As referring to FIG. 1, pulsed laser light 31 emitted from the laser device 3 may transmit through the window 21 and enter the inside of the chamber 2 as pulsed laser light 32 via the laser light traveling direction control actuator 34. The pulsed laser light 32 may travel from the laser device 3 to the inside of the chamber 2 on at least one laser beam path and be reflected from the laser light focusing mirror 22 to irradiate at least one target.

The droplet generator 26 may output a droplet target toward the plasma generation site 25 inside the chamber 2. The droplet target may be irradiated with at least one beam of pulsed laser light 33. A droplet target irradiated with the laser light may produce plasma so that EUV light may be generated from the plasma. One droplet target may be irradiated with a plurality of pulsed laser light beams.

The EUV light generation control system 5 may manage controlling of the whole of the EUV light generation system. The EUV light generation control system 5 may process information of an image of droplet 27 captured by the droplet imaging device 4 or the like. The EUV light generation control system 5 may also conduct, for example, at least one of a control of timing of emission of the droplet target 27 and a control of a direction of emission of the droplet target 27. The EUV light generation control system 5 may further conduct, for example, at least one of a control of timing of laser oscillation of the laser device 3, a control of a traveling direction of the pulsed laser light 31, and a control of a change in a focusing position. Various controls described above are merely illustrative and another control may be added as necessary.

2. EUV Light Generation Apparatus Including Pre-Pulsed Laser Device>

2.1 Configuration

Figure 2:
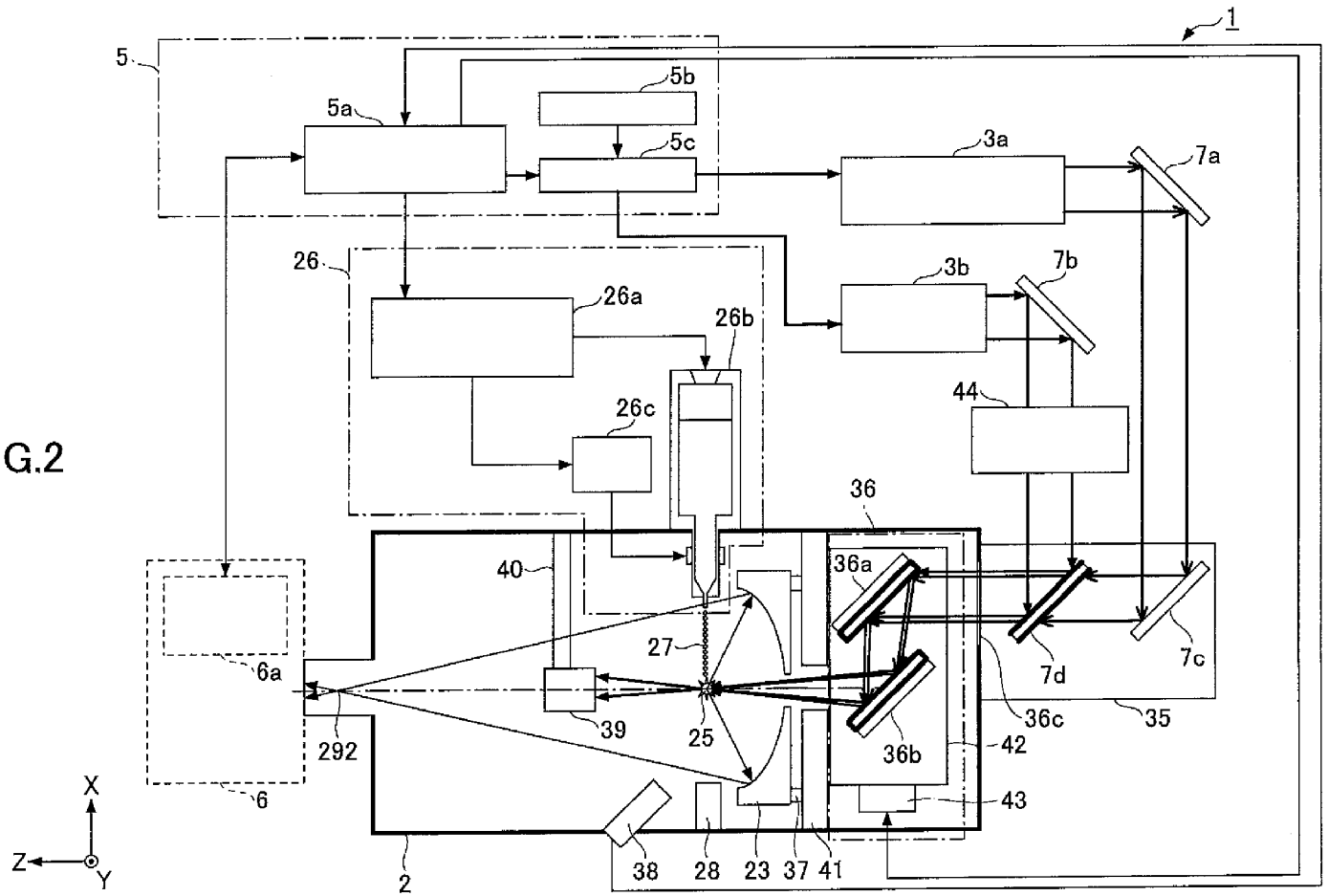
FIG. 2 is a diagram schematically illustrating an EUV light generation apparatus including a pre-pulsed laser light according to the present disclosure.

FIG. 2 schematically illustrates an EUV light generation apparatus including a pre-pulsed laser light according to the present disclosure.

An EUV light generation apparatus 1 may include an EUV light generation control system 5, a droplet generator 26, a main pulsed laser device 3*a*, a pre-pulsed laser device 3*b*, an EUV chamber 2, high-reflectance mirrors 7*a* and 7*b*, a beam combiner 35, and a beam shaping unit 44.

The EUV light generation control system 5 may include an EUV light generation apparatus controller 5*a*, a trigger generator 5*b*, and a delay circuit 5*c*. The droplet generator 26 may include a droplet generator controller 26*a*.

The beam combiner 35 may include a high-reflectance mirror 7*c* and a dichroic mirror 7*d*. The beam combiner 35 may be fixed to the EUV chamber 2. The dichroic mirror 7*d* may be such that a diamond substrate is coated with a coating for highly reflecting pre-pulsed laser light and transmitting main pulsed laser light.

The beam shaping unit 44 may be an optical system for beam-shaping a beam spot of a pre-pulsed laser light beam at a position 25 of irradiation of a droplet 27 into a desired beam spot shape. The details will be described below.

For example, a concave lens may be arranged in the beam shaping unit 44 in such a manner that a pre-pulsed laser light beam is focused on an elongated beam spot in a direction of a droplet sequence.

The EUV chamber 2 may include a window 36*c*, a laser light focusing optical system 36, an EUV focusing mirror 23, an EUV focusing mirror holder 37, a plate 41, a droplet production device 26*b*, an EUV light sensor 38, a damper 39, and a damper supporting member 40.

The droplet production device 26*b* may be arranged to supply a plurality of droplets 27 into a plasma production area 25.

The droplet production device 26*b* may be a target production device for producing droplets 27 based on a continuous jet method (hereinafter, abbreviated as a CJ method). The details will be described below.

The laser light focusing optical system 36 may include an off-axis parabolic mirror 36*a*, a plane mirror 36*b*, a plate 42, and a stage 43 that is moveable in XYZ directions. The laser light focusing optical system 36 may be arranged inside the EUV chamber 2. Each optical element may be arranged in such a manner that a position of a focal point of the laser light focusing optical system 36 is generally coincident with the plasma production area 25.

The high-reflectance mirror 7*a* and the high-reflectance mirror 7*c* may be arranged in such a manner that main pulsed laser light transmits through the dichroic mirror 7*d* and the window 36*c* and enters the laser light focusing optical system 36.

The high-reflectance mirror 7*b* and the dichroic mirror 7*d* may be arranged in such a manner that pre-pulsed laser light is reflected from the dichroic mirror 7*d*, transmits through the window 36*c*, and enters the laser light focusing optical system 36.

Herein, the dichroic mirror 7*d* and the high-reflectance mirror 7*c* may be arranged in such a manner that an optical path of pre-pulsed laser light reflected from the dichroic mirror 7*d* is generally coincident with an optical path of main pulsed laser light transmitting through the dichroic mirror 7*d*.

The pre-pulsed laser device 3*b* may be a YAG laser device for outputting pulsed laser light with a wavelength of 1.06 μm.

The main pulsed laser device 3*a* may be a $CO_2$ laser device for outputting pulsed laser light with a wavelength of 10.6 μm.

2.2 Operation

The EUV light generation apparatus controller 5*a* may receive an EUV light generation signal from a light exposure apparatus controller 6*a*. Subsequently, the EUV light generation apparatus controller 5*a* may cause the droplet production device 26*b* to produce a droplet-shaped target sequence based on the CJ method via the droplet generator controller 26*a*. Such a droplet-shaped target sequence may be supplied to the plasma production area 25 as a droplet sequence.

The EUV light generation apparatus controller 5*a* may input a trigger outputted from the trigger generator 5*b* into the pre-pulsed laser device 3*b* through the delay circuit 5*c* as a first trigger. Thereby, pre-pulsed laser light may be outputted from the pre-pulsed laser device 3*b*. The pre-pulsed laser light may be inputted into the window 36*c* through the high-reflectance mirror 7*b*, the beam shaping unit 44, and the dichroic mirror 7*d*. The pre-pulsed laser light may be focused into a beam spot with a longitudinally elongated shape by the laser light focusing optical system 36 and irradiate a plurality of droplets 27 disposed on a path of the droplets 27 in the plasma production area 25 in a direction of arrangement thereof. Then, the plurality of droplets 27 disposed on the path of the droplets 27 may be broken to diffuse as a target substance including fine particles (micro-droplets) or clusters.

On the other hand, a second trigger signal delayed by a predetermined delay time by the delay circuit 5*c* may be inputted into the main pulsed laser device 3*a*. Main pulsed laser light may be outputted from the main pulsed laser device 3*a* based on the second trigger signal. The main pulsed laser light may be inputted into the window 36*c* through the high-reflectance mirror 7*a*, the high-reflectance mirror 7*c*, and the dichroic mirror 7*d*. The main pulsed laser light may be focused into a spot with a predetermined diameter by the laser light focusing optical system 36 and irradiate a diffused target when a predetermined period of time has passed after irradiation with pre-pulsed laser light. Due to such irradiation, plasma of the diffused target may be produced to generate EUV light.

2.3 Effect

A plurality of droplets 27 on the path that have arrived at the plasma production area 25 may be irradiated with the pre-pulsed laser light. As a result, the plurality of droplets 27 irradiated with the pre-pulsed laser light may be broken to diffuse. Such a diffused target may have a higher absorbance and be irradiated with the main pulsed laser light, so that a conversion efficiency (CE) may be improved and production of debris may be suppressed.

2.4 Target Production Device Based on Continuous Jet Method

Figure 3:
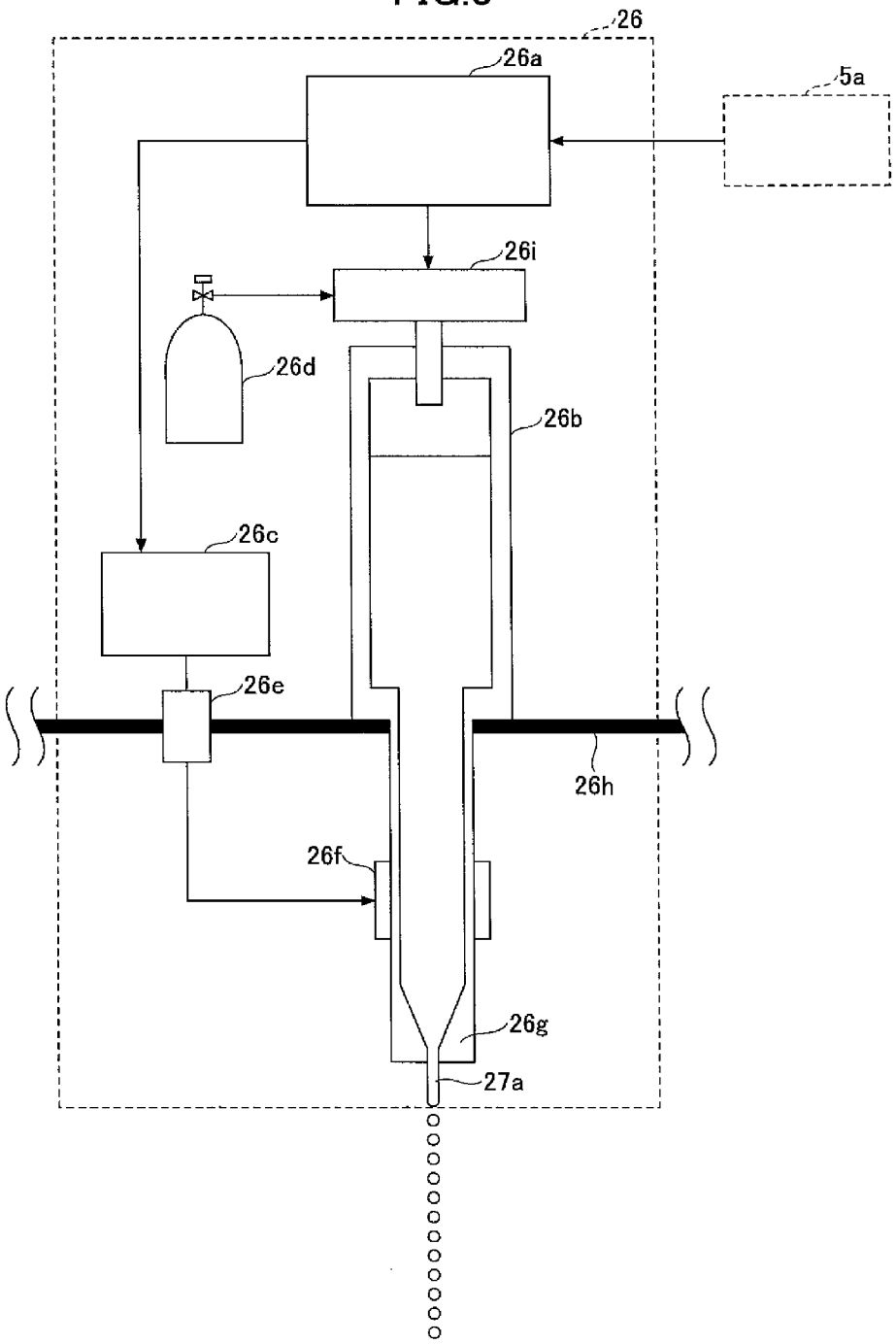
FIG. 3 is a diagram illustrating a target production device for producing a sequence of droplets by a continuous jet method according to the present disclosure.

FIG. 3 illustrates a target production device for producing a sequence of droplets 27 based on the CJ method. In the CJ method, a piezoelectric element 26*f* causes a nozzle 26*g* to vibrate so that a jet 27*a* exiting from the nozzle 26*g* is divided.

A droplet generator 26 may include a droplet production device 26*b*, a pressure controller 26*i*, an inert gas cylinder 26*d*, an electric power source 26*c*, and the piezoelectric element 26*f*.

An input side of the pressure controller 26*i* may be connected to the inert gas cylinder 26*d* via a pipeline and an output side of the pressure controller 26*i* may be connected to the droplet production device 26*b* via a pipeline.

The piezoelectric element 26*f* may be fixed to the nozzle 26*g* and connected to the electric power source 26*c* for applying a voltage to the piezoelectric element 26*f*.

The electric power source 26*c* may be connected to a droplet generator controller 26*a*.

When a droplet production signal is inputted from the EUV light generation apparatus controller 5*a*, the droplet generator controller 26*a* may send the signal to the pressure controller 26*i*. Thereby, the pressure controller 26*i* may apply a pressure to a target substance that is present inside the droplet production device 26*b* via an inert in such a manner that the inside of the droplet production device 26*b* is at a predetermined pressure.

When a pressure is applied to the target substance, a jet 27*a* of the target substance may be outputted from a pore of the nozzle 26*g*.

On the other hand, a pulsed signal with a predetermined frequency may be inputted from the droplet generator controller 26*a* to the electric power source 26*c*.

The electric power source 26*c* may apply a predetermined voltage to the piezoelectric element 26*f* at a frequency identical to a frequency of the pulsed signal via an electric current introduction terminal and thereby cause the nozzle 26*g* to vibrate.

The jet 27*a* may be divided by vibration of the nozzle 26*g* to form a droplet sequence.

Figures 4, 5:
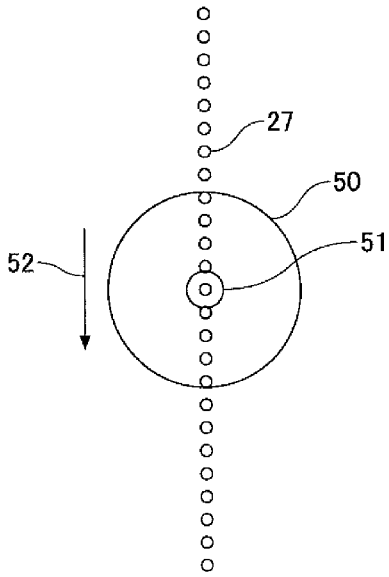
FIG. 4 is a diagram illustrating a relationship between a droplet diameter and a droplet intercentral distance in a case of the CJ method.
FIG. 5 is a diagram illustrating a part of droplets irradiated with a focused light beam of pre-pulsed laser light and a focused light beam of main pulsed laser light.

FIG. 4 illustrates an example of a relationship between a droplet diameter and a droplet center distance in a case of the CJ method.

In the CJ method, conditions for producing droplets may be restricted. According to Reyleigh's small disturbance stability theory, a target jet with a diameter d flowing at a velocity v is vibrated at a frequency f to cause a disturbance. In such a case, when a wavelength λ of vibration caused in a target flow ($\lambda=v/f$) satisfies a predetermined condition ($3<\lambda/d<8$), droplets with a generally uniform size are repeatedly formed at the frequency f. The frequency f is called a Reyleigh frequency.

FIG. 4 illustrates droplet diameters D, droplet intercentral distances λ, and the numbers of droplets in a case where a spot diameter of main pulsed laser light is 300 μm, when $\lambda/d=4.5$ is satisfied and nozzle diameters d are 10 μm and 3 μm.

In a case where a focused light beam diameter of main pulsed laser light is 300 μm, 7 and 23 droplets are present within an irradiation area for main pulsed laser light when the droplet diameters are 20 μm and 5.7 μm, respectively.

Thus, when one sequence of a plurality of droplets is thus preset within an area of a focused light beam diameter of main pulsed laser light, it is preferable to irradiate all the droplets with pre-pulsed laser light.

As illustrated in FIG. 4, it may be difficult for droplet production based on the CJ method to control a droplet distance and a droplet diameter independently.

In order to reduce a droplet diameter, a droplet distance can be reduced.

Here, a focused spot diameter Dp of pre-pulsed laser light may be controlled to be slightly greater than a diameter of one droplet and a spot diameter Dm of main pulsed laser light may be set to be comparable with a diameter of a target diffused by the pre-pulsed laser light. Dm may be greater than "4 Dp~5 Dp" (FIG. 5). FIG. 5 illustrates a focused light spot of pre-pulsed laser light 51 and a focused light spot of main pulsed laser light 50. These are illustrated for comparing both spot diameters. In practice, the droplets 27 are irradiated with pre-pulsed laser light, and subsequently, irradiated with a main pulsed laser light.

When a droplet distance is small, a situation can be supposed that, for example, only one droplet is irradiated with pre-pulsed laser light on a condition that a plurality of droplets are present in the spot diameter Dm of main pulsed laser light.

Figure 6:
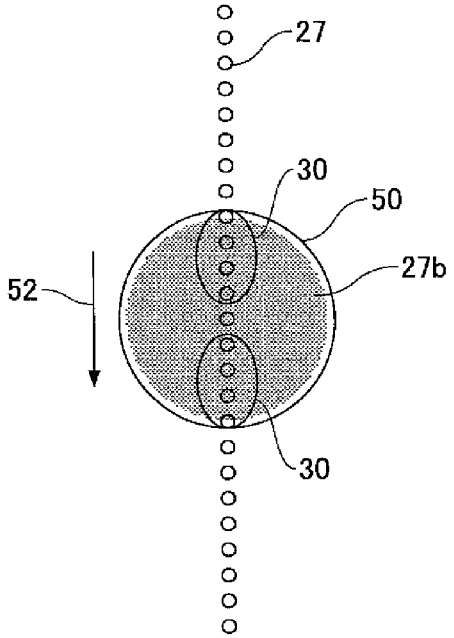
FIG. 6 is a diagram illustrating a result of irradiation of a part of droplets with a focused light beam of pre-pulsed laser light and a focused light beam of main pulsed laser light.

In FIG. 6, an arrow 52 indicates a traveling direction of a droplet. When one droplet is irradiated with pre-pulsed laser light, such a droplet target can be diffused. When a size of a diffused target 27*b* is comparable with a diameter Dm of a spot 50 of main pulsed laser light after a predetermined period of time (FIG. 6), irradiation with main pulsed laser light may be conducted. In such a case, a plurality of other droplets presented in two elongated circles 30 in FIG. 6 are not irradiated with pre-pulsed laser light, and a phenomenon can occur that a droplet is directly irradiated with main pulsed laser light. A droplet that has not been diffused has a lower absorbance, and as a result, degradation of the CE or an increase of debris can be caused.

2.5 Beam Shaping Unit for Pre-Pulsed Laser Light>

Figure 7:
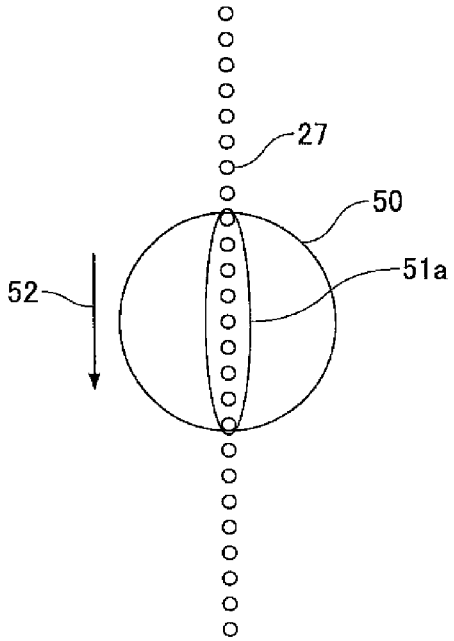
FIG. 7 is a diagram illustrating a focused light beam of pre-pulsed laser light with a beam spot that is beam-shaped into an elongated circular shape.
Figure 8:
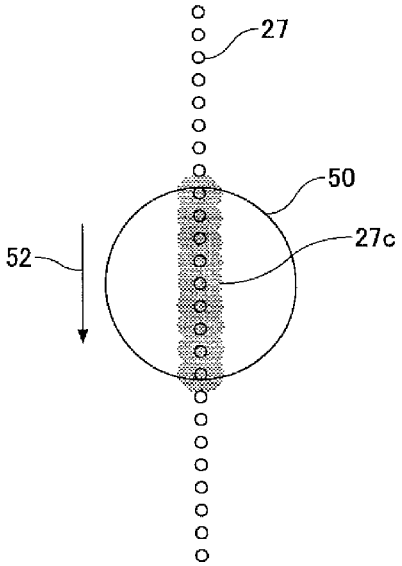
FIG. 8 is a diagram illustrating a result of irradiation of droplets with a focused light beam of pre-pulsed laser light with a beam spot that is beam-shaped into an elongated circular shape.
Figure 9:
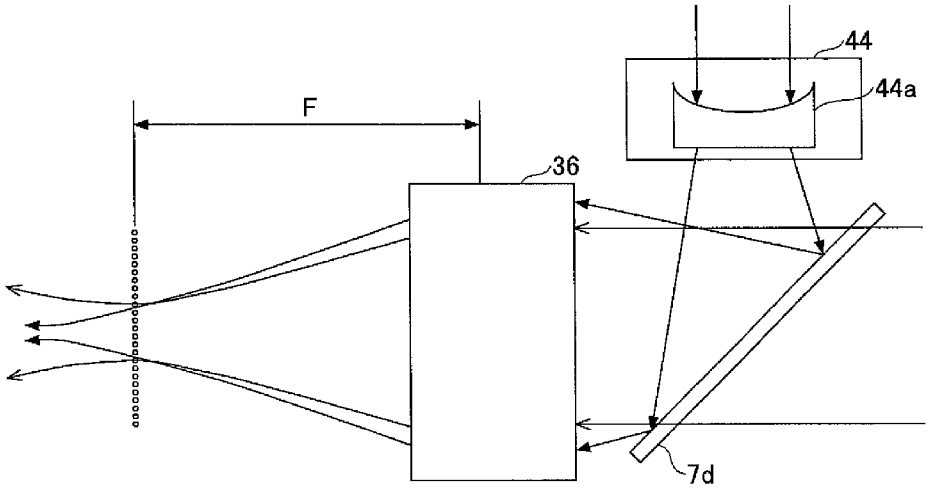
FIG. 9 is a diagram illustrating an optical system for beam-shaping a beam spot of an irradiation beam of pre-pulsed laser light into an elongated circle and beam-shaping a beam spot of an irradiation beam of main pulsed laser light into a circular shape.

FIGS. 7 to 9 illustrate embodiments in a case where pre-pulsed laser light is focused into an elongated circular shape. A focused light beam of pre-pulsed laser light is indicated by "51*a*" in the figure.

FIG. 8 is a diagram illustrating a state of a plurality of diffused droplets 27*c* when a predetermined period of time has passed after irradiation with pre-pulsed laser light is conducted. Such a diffused target may be irradiated with main pulsed laser light. As illustrated in FIG. 8, main pulsed laser light may be beam-shaped so that a plurality of droplets 27*c* irradiated with pre-pulsed laser light is included in a focused light beam 50 of main pulsed laser light.

FIG. 9 illustrates an optical system for providing an irradiation beam of pre-pulsed laser light with an elongated circular shape and an irradiation beam of main pulsed laser light with a circular shape.

The optical system may include a laser light focusing optical system 36, a dichroic mirror 7*d*, and a beam shaping unit 44.

The laser light focusing optical system 36 may include an off-axis parabolic mirror 36*a* and a plane mirror 36*b*, as illustrated in FIG. 2. When a wavelength of main pulsed laser light is generally coincident with a wavelength of pre-pulsed laser light, the laser light focusing optical system 36 may include a lens.

The laser light focusing optical system 36 may be arranged in such a manner that an axis of a droplet sequence in a traveling direction thereof is generally coincident with a focal plane of the laser light focusing optical system 36 so that a laser beam is focused in a desired plasma production area 25.

The dichroic mirror 7*d* may be such that a substrate thereof is made of a material that highly transmits main pulsed laser light. The dichroic mirror 7*d* may be coated with a coating that highly reflects pre-pulsed laser light and highly transmits main pulsed laser light.

The beam shaping unit 44 may be placed on an optical path between the dichroic mirror 7*d* and the pre-pulsed laser device 3*b*.

The beam shaping unit 44 may include a concave cylindrical lens 44*a*.

The concave cylindrical lens 44*a* may be arranged in such a manner that an axis of a droplet sequence in a traveling direction thereof is generally orthogonal to a focal axis of the concave cylindrical lens 44*a* and a plurality of droplets are irradiated with a focused light beam of pre-pulsed light.

As illustrated in FIG. 9, a pre-pulsed laser light beam may be expanded in a direction parallel to the plane of paper by the concave cylindrical lens 44*a*. Subsequently, the pre-pulsed laser light beam may be incident on and highly reflected from the dichroic mirror 7*d*, and then, focused onto one sequence of a plurality of droplets by the laser light focusing optical system 36 as a beam spot with an elongated circular shape.

On the other hand, main pulsed laser light may highly transmit through the dichroic mirror 7*d*, and then, be focused at a position of a focal point by the laser light focusing optical system 36. At that time, a focused light spot diameter of main pulsed laser light may be controlled based on a wavelength and an NA. Specifically, a focused light spot diameter of main pulsed laser light may be controlled by utilizing that it is proportional to a wavelength and inversely proportional to a numerical aperture (NA). For example, when both laser light beams have an identical NA and an identical $M^2$, a spot diameter of main pulsed laser light with a wavelength of 10.6 μm can be about 10 times greater than that of pre-pulsed laser light with a wavelength of 1.06 μm.

A focused light spot of main pulsed laser light may be circular and include all the area irradiated with a focused light beam of pre-pulsed laser light with an elongated circular shape.

As illustrated in FIG. 7, a plurality of droplets present in a plasma production area may be irradiated with a pre-pulsed laser light beam with an elongated circular shape. Then, a target diffused by irradiating the plurality of droplets with the pre-pulsed laser light may be irradiated with main pulsed laser light. As a result, the irradiated and diffused target may be caused to produce plasma and thereby generate EUV light.

A plurality of droplets present in an area (spot diameter) irradiated with main pulsed laser light can be irradiated with pre-pulsed laser light to have formed a diffused target. Since such a distributed and diffused target is irradiated with main pulsed laser light, the CE may be improved and production of debris may be suppressed.

3. Other Embodiments of Beam Shaping Unit for Pre-Pulsed Laser Light

Figure 10:
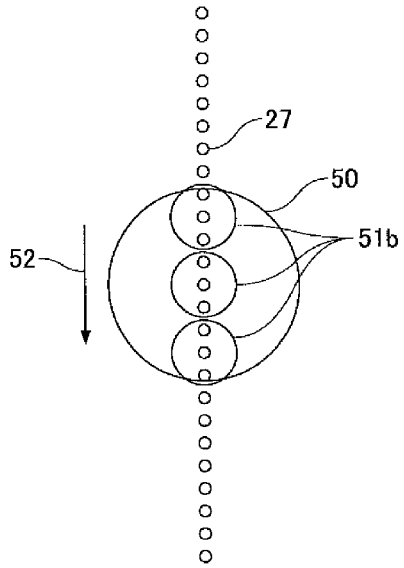
FIG. 10 is a diagram illustrating a focused light beam of pre-pulsed laser light that is beam-shaped to provide a plurality of spots.
Figure 11:
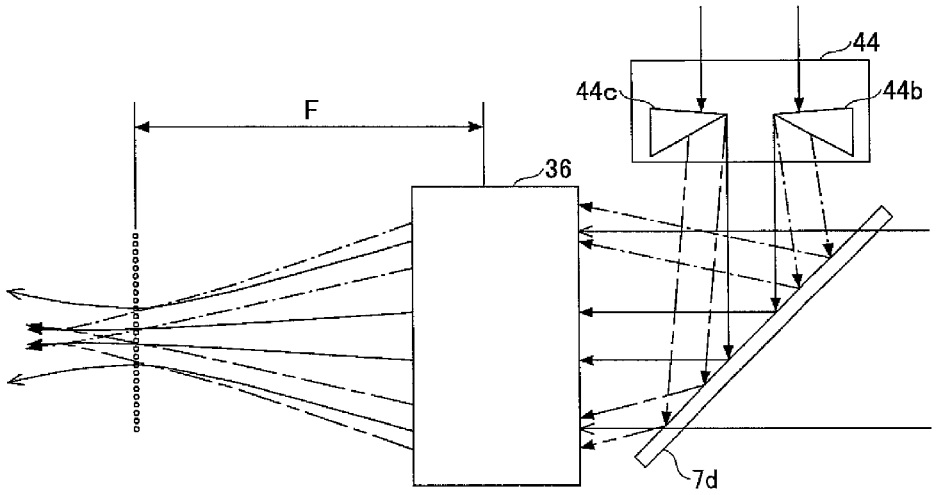
FIG. 11 is a diagram illustrating an optical system for beam-shaping an irradiation beam of pre-pulsed laser light to provide a plurality of spots and beam-shaping an irradiation beam of main pulsed laser light into a circular shape.

FIGS. 10 and 11 illustrate embodiments in a case where pre-pulsed laser light is focused into a plurality of spots. FIG. 10 illustrates both a focused light beam 51*b* of pre-pulsed laser light and a focused light beam 50 of main pulsed laser light. However, in practice, droplets 27 are irradiated with pre-pulsed laser light, and subsequently, irradiated with main pulsed laser light. The purpose of describing both of them is to illustrate a relationship of diameters and light focusing positions between the focused light beam 51*b* of pre-pulsed laser light and the focused light beam 50 of main pulsed laser light.

Similarly to the case of FIG. 7, a plurality of droplets irradiated with pre-pulsed laser light may be included in a focused light beam of main pulsed laser light. As illustrated in FIG. 10, a focused light beam of pre-pulsed laser light may be beam-shaped to provide a plurality of spots 51*b* in such a manner that a plurality of droplets are included in the focused light beam 50 of main pulsed laser light. In the present embodiment, the number of the plurality of spots is three.

FIG. 11 illustrates an optical system for providing a plurality of spots of an irradiation beam of pre-pulsed laser light and an irradiation beam of main pulsed laser light with a circular shape.

A configuration illustrated in FIG. 11 is generally identical to the configuration illustrated in FIG. 9. However, the configuration illustrated in FIG. 11 is different from the configuration illustrated in FIG. 9 in that two prisms 44*b* and 44*c* are arranged in a beam shaping unit 44.

A first prism 44*b* and a second prism 44*c* are placed at a predetermined distance and one irradiation beam of pre-pulsed laser light may be divided into three beams. Each of two divided beams produced as transmitting through the first prism 44*b* and the second prism 44*c* may be refracted at a predetermined angle.

As illustrated in FIG. 11, a pre-pulsed laser light beam can be divided into three beams by the first prism 44*b* and the second prism 44*c*. Thus divided three beams may be incident on and highly reflected from a dichroic mirror 7*d* and then focused into three spots by the laser light focusing optical system 36.

3.1 Beam Shaping Unit for Producing a Plurality of Beams

Figure 12:
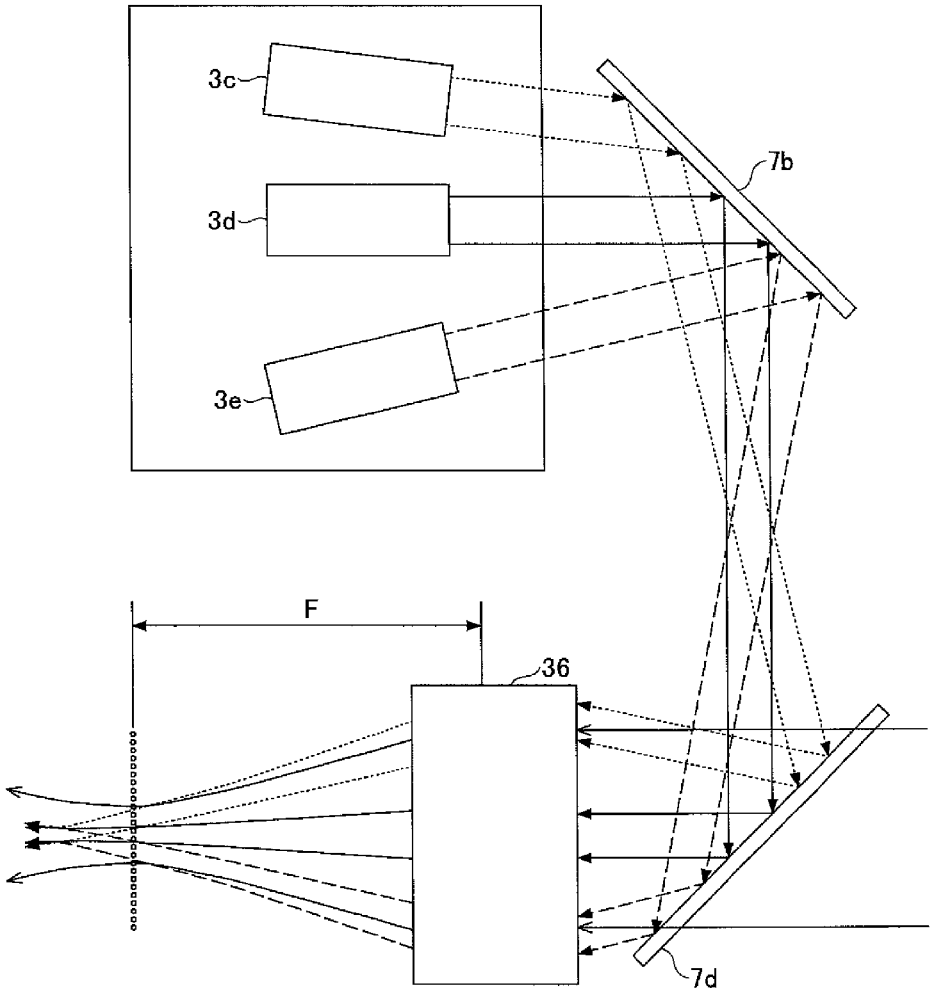
FIG. 12 is a diagram illustrating a second embodiment in a case where pre-pulsed laser light is focused into a plurality of spots.

FIG. 12 illustrates a second embodiment in a case where pre-pulsed laser light is focused into a plurality of spots. The configuration illustrated in FIG. 12 is generally identical to the configuration illustrated in FIG. 9. However, the configuration illustrated in FIG. 12 is different from the configuration in FIG. 9 in that a plurality of pre-pulsed laser devices 3*c*, 3*d*, and 3*e* are included and a direction of emission of each pre-pulsed laser light is oriented to a predetermined direction to be mutually different.

Alternatively, a plurality of mirrors placed at different angles may be arranged between each pre-pulsed laser device 3*c*, 3*d*, or 3*e* and a dichroic mirror 7*d*.

3.2 Beam Shaping Unit for Producing Sheet Beam>

Figure 13:
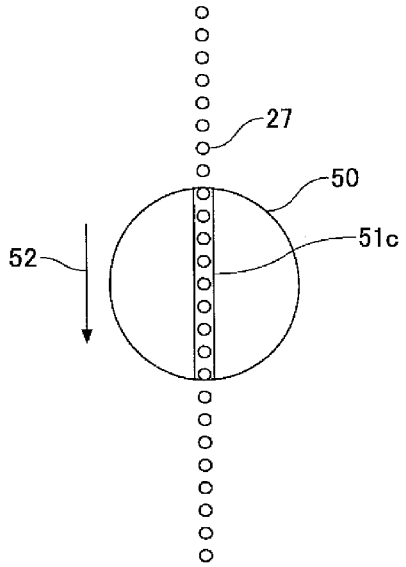
FIG. 13 is a diagram illustrating a focused light beam of pre-pulsed laser light that is beam-shaped into a sheet-shaped beam.
Figure 14:
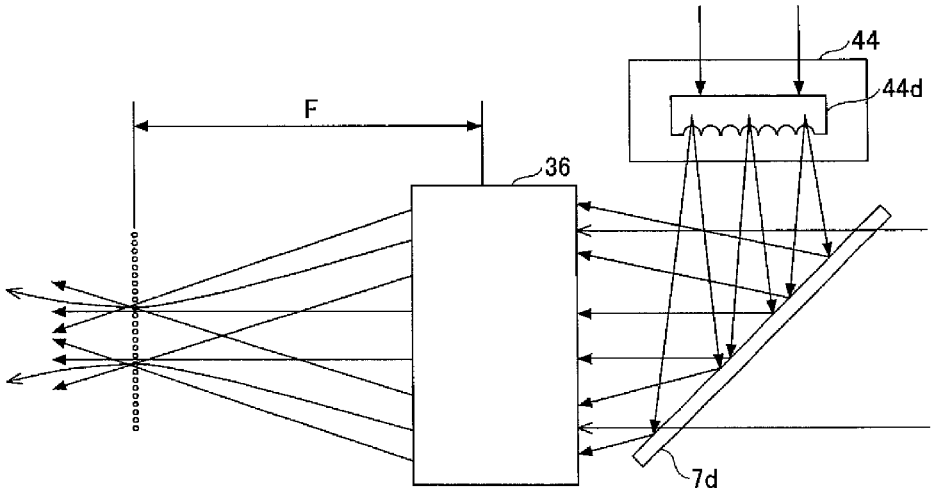
FIG. 14 is a diagram illustrating an optical system for beam-shaping an irradiation beam spot of pre-pulsed laser light into a sheet shape and beam-shaping a beam spot of an irradiation beam of main pulsed laser light into a circular shape.

FIGS. 13 and 14 illustrate embodiments in a case where pre-pulsed laser light is focused into a sheet-shaped beam spot. FIG. 13 illustrates both a focused light beam 51*c* of pre-pulsed laser light and a focused light beam 50 of main pulsed laser light. However, in practice, droplets 27 are irradiated with pre-pulsed laser light, and subsequently, irradiated with main pulsed laser light. The purpose of illustrating both of them is to illustrate a relationship of diameters and light focusing positions between the focused light beam 51*c* of pre-pulsed laser light and the focused light beam 50 of main pulsed laser light.

Also in the present embodiment, a plurality of droplets irradiated with pre-pulsed laser light may be included in a focused light beam of main pulsed laser light. As illustrated in FIG. 13, a focused light beam of pre-pulsed laser light may be beam-shaped into the sheet-shaped beam 51*c* in such a manner that a plurality of droplets 27 are included in a focused light beam of main pulsed laser light.

FIG. 14 illustrates an optical system for beam-shaping an irradiation beam of pre-pulsed laser light into a sheet shape and providing an irradiation beam of main pulsed laser light with a circular shape.

The configuration illustrated in FIG. 14 is generally identical to the configuration illustrated in FIG. 9. However, the configuration illustrated in FIG. 14 is different from the configuration illustrated in FIG. 9 in that a micro-fly-eye lens 44*d* is arranged in a beam shaping unit 44.

The micro-fly-eye lens 44*d* may be an optical element processed by providing on a substrate a plurality of, typically several hundred or more, rectangular concave lenses that have a similarity shape with the focused light beam 51*c* of pre-pulsed laser light in FIG. 13 in such a manner that the pre-pulsed laser light is focused into a focused light beam with a sheet shape.

A pre-pulsed laser light beam can be divided into a plurality of beams by the micro-fly-eye lens 44*d* and the plurality of divided beams can be expanded by respective lenses. Then, the plurality of beams expanded by respective lenses may be incident on and highly reflected from the dichroic mirror 7*d*, and subsequently, overlapped by a laser light focusing optical system 36 at a position of a focal point thereof to produce a sheet-shaped beam (Koehler illumination).

Since a droplet sequence is irradiated with pre-pulsed laser light with a rectangular or top-hat shape, a condition of a produced diffused target can be stabilized when positions of a plurality of droplets 27 are present in an area of uniform pre-pulsed laser light.

Although a micro-fly-eye lens is used in the present embodiment, a diffractive optical element may be used in such a manner that pre-pulsed laser light is focused into a beam spot with a sheet-like and top hat shape.

4. Embodiments of Irradiation with a Plurality of Pre-Pulsed Laser Light

FIGS. 15 to 19 illustrate other embodiments in which a plurality of droplets irradiated with pre-pulsed laser light are included in a focused light beam of main pulsed laser light. The embodiment is the case that droplets 27 are irradiated with a plurality of pre-pulsed laser light beams at different times. FIGS. 15 to 18 illustrate both a focused light beam 51*d* of pre-pulsed laser light and a focused light beam 50 of main pulsed laser light. However, in practice, droplets 27 are irradiated with pre-pulsed laser light, for example, three times, and then, irradiated with main pulsed laser light. The purpose of illustrating both of them in each figure is to illustrate a relationship of diameters and light focusing positions between the focused light beam of pre-pulsed laser light 51*d* and the focused light beam of main pulsed laser light 50.

Figure 15:
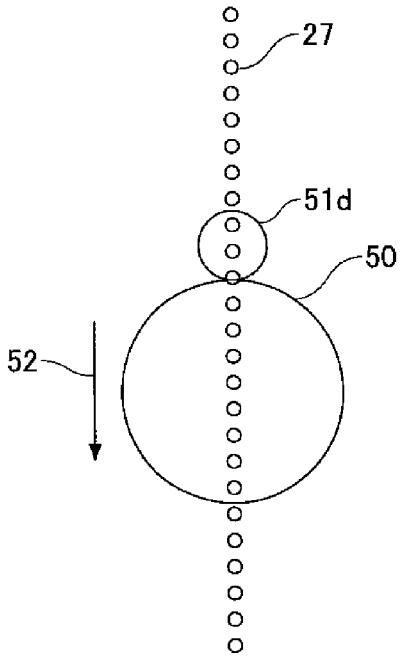
FIG. 15 is a diagram illustrating irradiation of droplets with pre-pulsed laser light and main pulsed laser light.

FIG. 15 illustrates a relationship between the focused light spot 50 of main pulsed laser light and the focused light spot 51*d* of pre-pulsed laser light.

The focused light spot of pre-pulsed laser light 51*d* may be located at an upstream side in a traveling direction of a droplet sequence with respect to the focused light spot 50 of main pulsed laser light.

Figure 16:
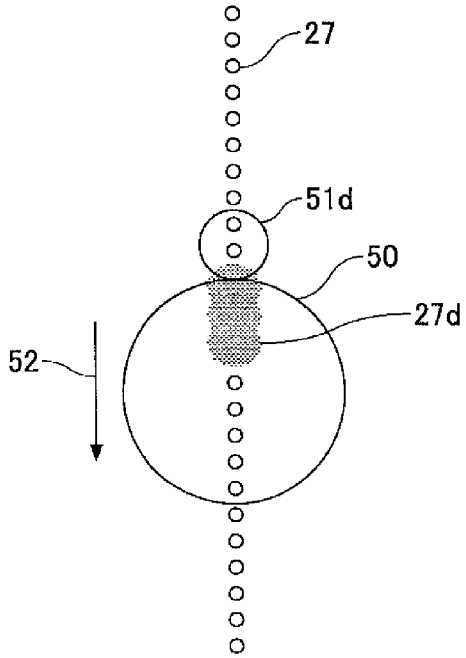
FIG. 16 is a diagram illustrating a state when a predetermined period of time has passed after droplets are irradiated with pre-pulsed laser light.

FIG. 16 illustrates states of droplets 27 and a diffused target 27*d* when a predetermined period of time T1 has passed after irradiation is conducted with first pre-pulsed laser light.

At that time, the diffused target 27*d* and the droplets 27 have moved in a traveling direction as indicated by an arrow 52 and the droplets 27 can be present on a focused light spot of pre-pulsed laser light and irradiated with second pre-pulsed laser light.

Figure 17:
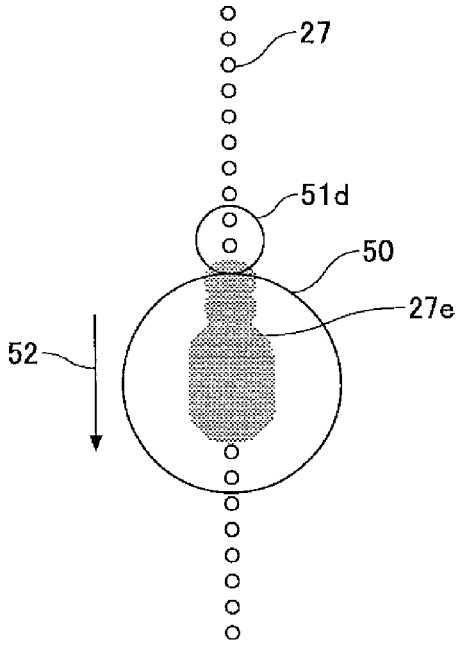
FIG. 17 is a diagram illustrating a state when a predetermined period of time has passed after droplets are irradiated with pre-pulsed laser light.

FIG. 17 illustrates states of droplets 27 and a diffused target 27*e* when a predetermined period of time T1 has passed after irradiation is conducted with the second pre-pulsed laser light. At that time, the diffused target 27*e* and the droplets 27 have moved in a traveling direction indicated by an arrow 52 and the droplets 27 can be present on a focused light spot of pre-pulsed laser light and irradiated with third pre-pulsed laser light.

Figure 18:
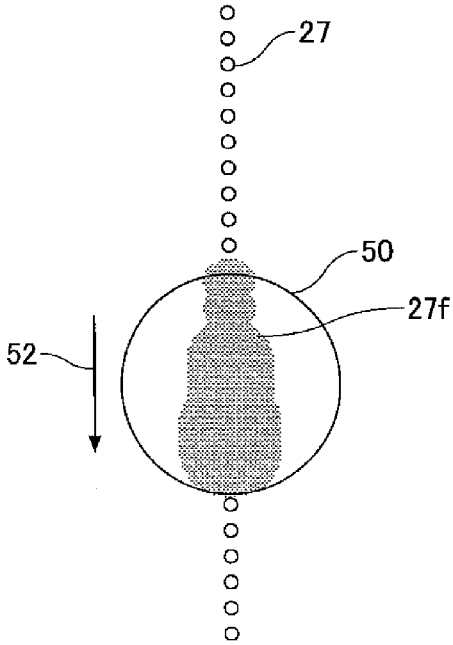
FIG. 18 is a diagram illustrating a state when a predetermined period of time has passed after droplets are irradiated with pre-pulsed laser light.

FIG. 18 illustrates states of droplets 27 and a diffused target 27*f* when a predetermined period of time T1 has passed after the droplets 27 are irradiated with the third pre-pulsed laser light.

Figure 19:
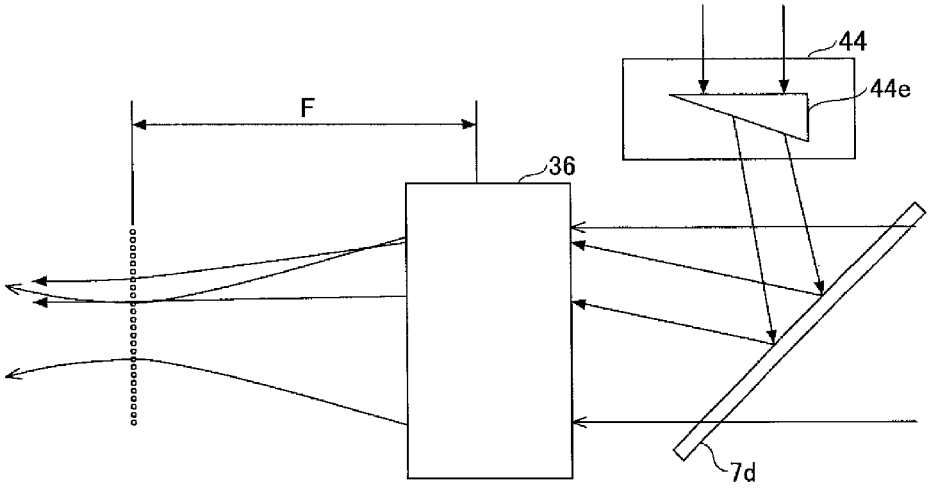
FIG. 19 is a diagram illustrating another optical system for beam-shaping an irradiation beam spot of pre-pulsed laser light into an elongated circle and beam-shaping an irradiation beam spot of main pulsed laser light into a circular shape.

The configuration illustrated in FIG. 19 is generally identical to the configuration illustrated in FIG. 9. However, the configuration illustrated in FIG. 19 is different from the configuration illustrated in FIG. 9 in that one prism 44*e* is arranged in a beam shaping unit 44.

An optical path of pre-pulsed laser light may be bent by a predetermined angle by the prism 44*e*.

The focused light spot 51*d* of pre-pulsed laser light may be located at an upstream side of a droplet sequence with respect to the focused light spot 50 of main pulsed laser light.

A difference between the EUV light generation apparatus according to the embodiment of FIGS. 15 to 19 and the EUV light generation apparatus according to the embodiment of FIG. 2 may be in the delay circuit 5*c*.

Timing of outputs of three trigger signals to a pre-pulsed laser device and one trigger signal to a main pulsed laser device may be set in the delay circuit 5*c* by an EUV light generation apparatus controller 5*a*.

For the case illustrated in FIG. 15, a first trigger signal outputted from a trigger generator 5*b* may directly be inputted into the pre-pulsed laser device without being delayed. As a result, a plurality of droplets 27 may be irradiated with the first pre-pulsed laser light.

For the case illustrated in FIG. 16, a second trigger signal delayed by T1 with respect to the first trigger signal may be outputted from the delay circuit 5*c* to the pre-pulsed laser device in synchronization. As a result, a plurality of droplets 27 may be irradiated with the second pre-pulsed laser light.

For the case illustrated in FIG. 17, a third trigger signal delayed by T2 (=2*T1) with respect to timing of the first trigger signal may be outputted to the pre-pulsed laser device. As a result, a plurality of droplets 27 may be irradiated with the third pre-pulsed laser light.

As illustrated in FIG. 18, a fourth trigger signal delayed by T3 (=3*T1) with respect to timing of the first trigger signal may be outputted to the main pulsed laser device. As a result, the diffused target 27*f* irradiated with a plurality of pre-pulsed laser light beams can be irradiated with a main pulsed light beam. As a result, the diffused target 27*f* can be caused to produce plasma and thereby generate EUV light.

As described above, a plurality of droplets may be irradiated with a plurality of pre-pulsed laser light beams at different times to diffuse a target substance.

5. EUV Light Generation Apparatus Including Polarization Adjustment Unit

Figure 20:
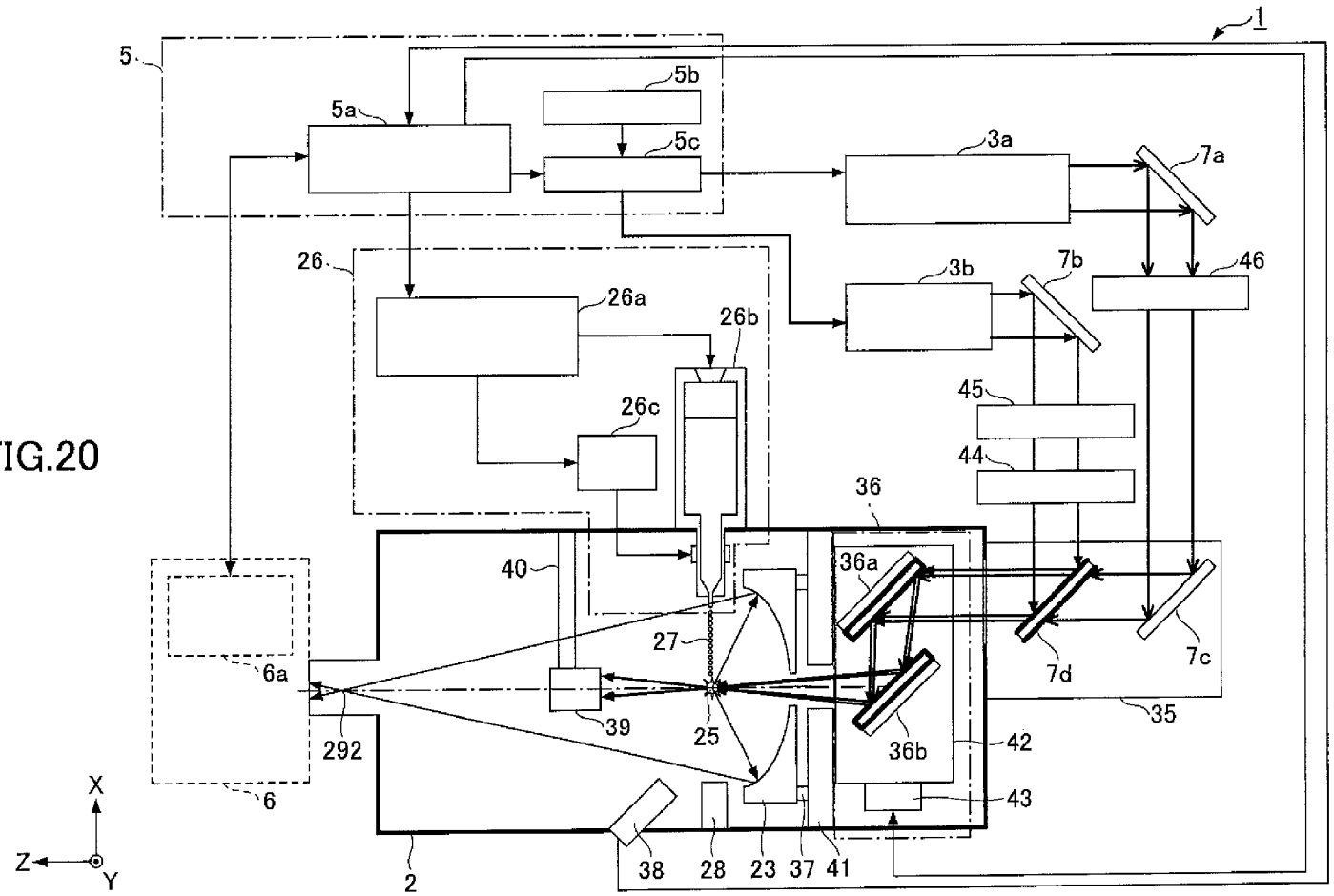
FIG. 20 is a diagram illustrating an EUV light generation apparatus including a polarization adjustment unit and an additional beam shaping unit.

FIG. 20 illustrates an EUV light generation apparatus including a polarization adjustment unit.

As illustrated in FIG. 20, a polarization adjustment unit 45 may be placed on an optical path between a pre-pulsed laser device 3*b* and a dichroic mirror 7*d* and a beam shaping unit 46 may be placed on an optical path between a main pulsed laser device 3*a* and the dichroic mirror 7*d*.

Next, the operation of each component will be described. The polarization adjustment unit 45 may adjust a direction of polarization of pre-pulsed laser light. The beam shaping unit 46 may adjust a beam shape of main pulsed laser light.

Figure 21:
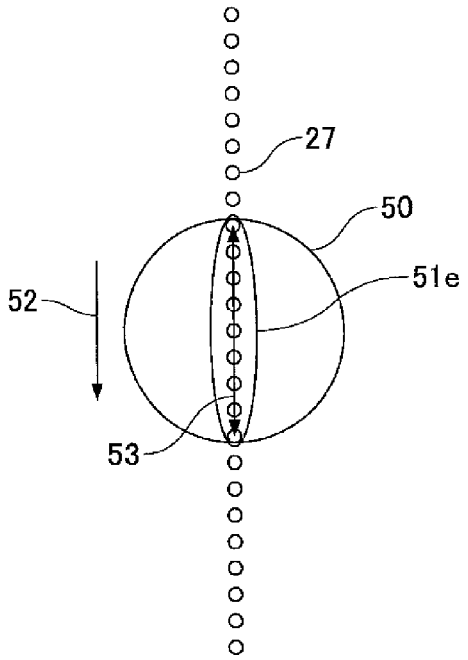
FIG. 21 is a diagram illustrating a focused light beam of elliptically polarized pre-pulsed laser light with a polarization direction that is generally coincident with a traveling direction of droplets.

FIG. 21 illustrates an example of irradiation with a focused light beam having an elongated circular shape so that a direction of polarization 53 of pre-pulsed laser light is generally coincident with a traveling direction of droplet 52. FIG. 21 illustrates both a focused light beam 51*e* of pre-pulsed laser light and a focused light beam 50 of main pulsed laser light. However, in practice, droplets 27 are irradiated with pre-pulsed laser light and subsequently irradiated with main pulsed laser light. The purpose of illustrating both of them is to illustrate a relationship of diameters and light focusing positions between the focused light beam 51*e* of pre-pulsed laser light and the focused light beam 50 of main pulsed laser light.

Figure 22:
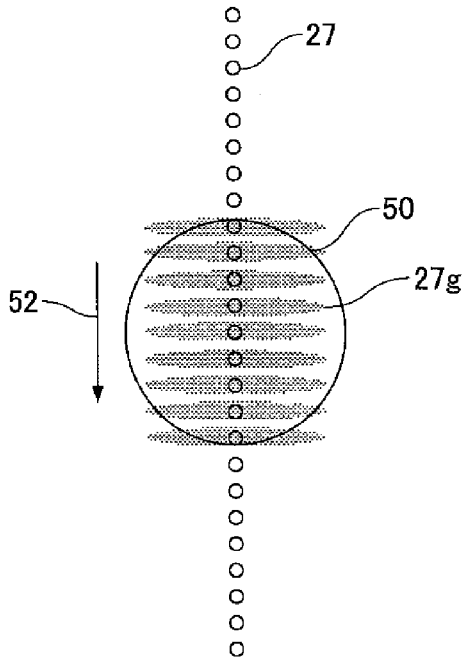
FIG. 22 is a diagram illustrating a target substance diffused as a result of irradiation of a plurality of droplets with pre-pulsed laser light.

FIG. 22 illustrates diffused targets 27*g* in a case where a plurality of droplets 27 are irradiated with pre-pulsed laser light. The inventors of the present application have found that when droplets are irradiated with pulsed laser light with linear polarization, a target is principally diffused in a direction perpendicular to a polarization direction 53 as illustrated in FIG. 22.

Figure 23:
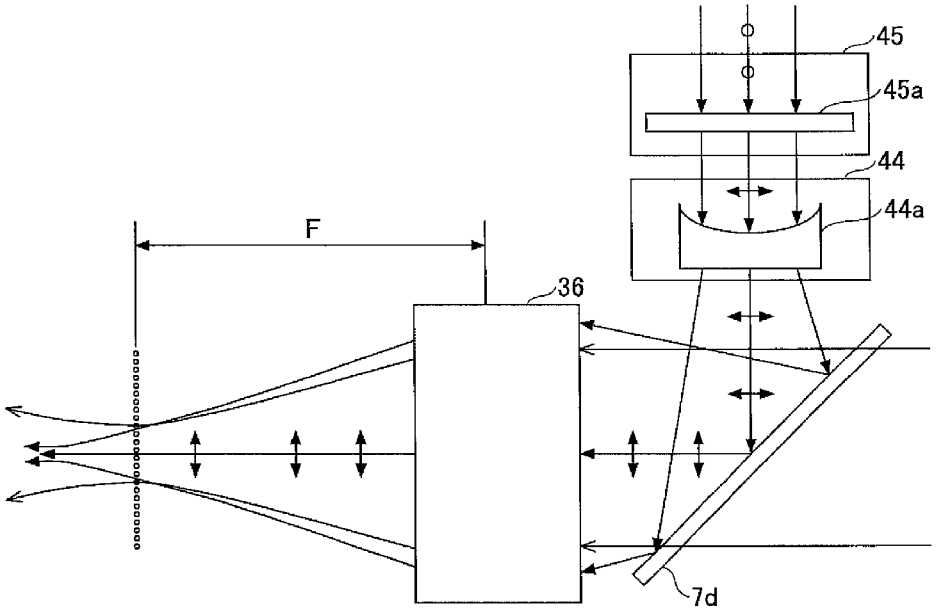
FIG. 23 is a diagram illustrating an optical system for irradiating droplets with pre-pulsed laser light and main pulsed laser light as illustrated in FIG. 21.

FIG. 23 illustrates an optical system for conducting irradiation in FIG. 21.

An embodiment illustrated in FIG. 23 is generally identical to the embodiment illustrated in FIG. 9. However, the embodiment illustrated in FIG. 23 is different from the embodiment illustrated in FIG. 9 in that a half-wave plate (λ/2 plate) 45*a* is placed on an optical path between a dichroic mirror 7*d* and a pre-pulsed laser device (not illustrated).

The pre-pulsed laser device may be a laser device for outputting pulsed laser light with linear polarization.

The polarization adjustment unit 45 may be the λ/2 plate 45*a*.

Pre-pulsed laser light with linear polarization having a polarization direction perpendicular to the plane of paper may be incident on the λ/2 plate 45*a*.

The pre-pulsed laser light may transmit through the λ/2 plate 45*a* so that the polarization direction thereof may be rotated by 90° to produce a polarization direction that is a direction included in the plane of paper. When a plurality of droplets 27 are irradiated with pre-pulsed laser light with linear polarization, a target irradiated with the pre-pulsed laser light with linear polarization may be diffused in a direction orthogonal to a direction of the polarization.

Such a diffused target 27*g* may be irradiated with main pulsed laser light to produce plasma and thereby generate EUV light.

A placement angle (an angle of a polarization direction with respect to an optical axis) θ (45° in the figure) of the λ/2 plate 45*a* may be adjusted in such a manner that a direction of polarization of pre-pulsed laser light 53 may be generally coincident with a traveling direction 52 of droplets.

Since the diffused target 27*g* can generally fill an area of a focused light spot of main pulsed laser light as illustrated in FIG. 22, the CE can be improved.

In the present embodiment, the placement angle of the λ/2 plate 45*a* is adjusted in such a manner that the direction of polarization of pre-pulsed laser light is generally coincident with the traveling direction of droplets. However, adjustment and placement thereof may be conducted to, for example, rotate about an optical path or axis of pre-pulsed laser light, without being limited to the present embodiment. Basically, it is sufficient to include a mechanism that can adjust a polarization direction.

Although a case where droplets are irradiated with pre-pulsed laser light with linear polarization is illustrated in the present embodiment, droplets may be irradiated with pre-pulsed laser light with elliptical polarization, without being limited to the present embodiment. When droplets are irradiated with pre-pulsed laser light with elliptical polarization, it is sufficient that a direction of a longitudinal axis of the ellipse thereof is generally coincident with a traveling direction of droplets.

6. Embodiments of Beam Shaping Unit for Main Pulsed Laser Light

Figure 24:
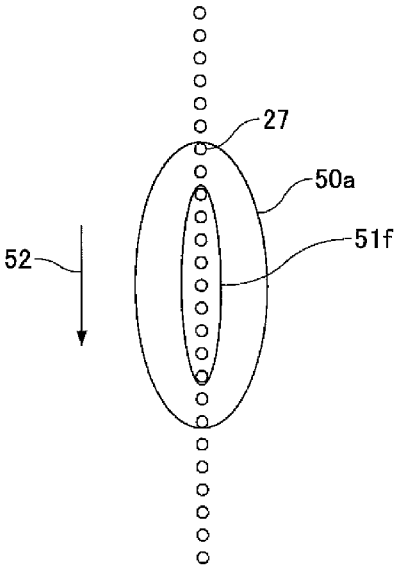
FIG. 24 is a diagram illustrating a focused light beam of pre-pulsed laser light and a focused light beam of main pulsed laser light that have elongated circular shapes with longitudinal axes in a traveling direction of a plurality of droplets.
Figure 25:
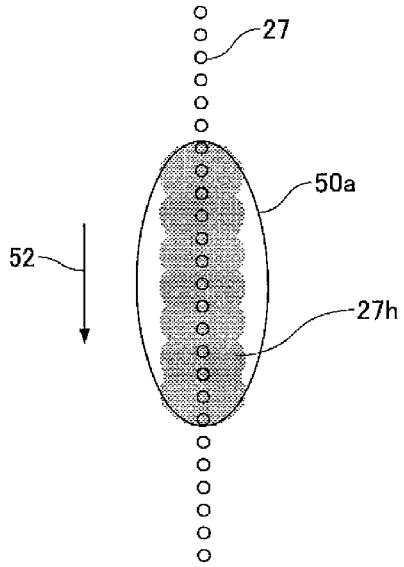
FIG. 25 is a diagram illustrating a target substance diffused after a plurality of droplets are irradiated with pre-pulsed laser light.
Figure 26:
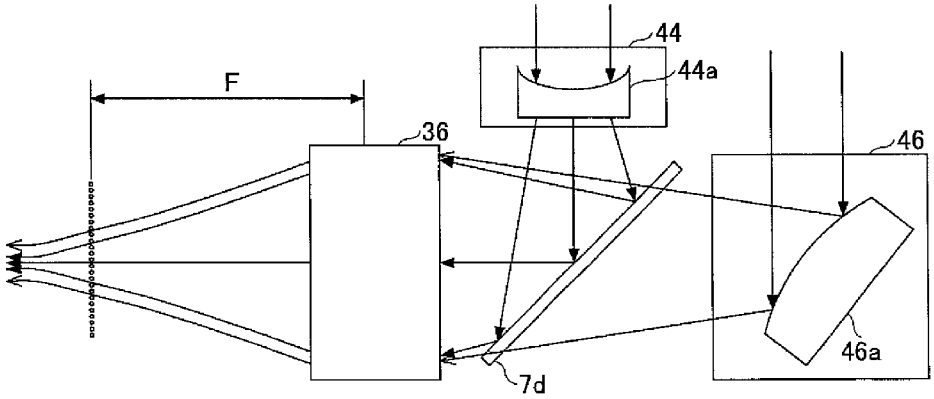
FIG. 26 is a diagram illustrating an optical system for irradiating droplets with pre-pulsed laser light and main pulsed laser light as illustrated in FIG. 24.

FIGS. 24 to 26 illustrate an embodiment in a case where a spot of a focused light beam of main pulsed laser light has an elongated circular shape. FIG. 24 illustrates both a focused light beam 51*f* of pre-pulsed laser light and a focused light beam 50*a* of main pulsed laser light. However, in practice, droplets 27 are irradiated with pre-pulsed laser light and subsequently irradiated with main pulsed laser light. The purpose of illustrating both of them is to illustrate a relationship of diameters and light focusing positions between the focused light beam 51*f* of pre-pulsed laser light and the focused light beam 50*a* of main pulsed laser light.

FIG. 24 illustrates a case where the focused light beam 51*f* of pre-pulsed laser light and the focused light beam 50*a* of main pulsed laser light have elongated circular shapes with a longitudinal axis in a traveling direction 52 of a plurality of droplets 27.

FIG. 25 illustrates a schematic diagram of a condition that a target is diffused after a plurality of droplets are irradiated with pre-pulsed laser light.

FIG. 26 illustrates an optical system for conducting irradiation illustrated in FIG. 24.

The optical system illustrated in FIG. 26 is generally identical to the optical system illustrated in FIG. 9. However, the optical system illustrated in FIG. 26 is different from the embodiment illustrated in FIG. 9 in that a beam shaping unit 46 is placed on an optical path between a main pulsed laser device (not illustrated) and a dichroic mirror 7*d*.

The beam shaping unit 46 may be a convex cylindrical mirror 46*a*. Preferably, it may be a convex cylindrical mirror 46*a* with an off-axis parabolic surface.

A beam of main pulsed laser light may be expanded in a direction that is generally identical to a traveling direction 52 of droplets 27 by the convex cylindrical mirror 46*a* in the beam shaping unit 46.

Main pulsed laser light may be focused into a beam spot with an elongated circular shape on a focal plane of a laser light focusing optical system 36.

Since a longitudinally diffused target 27*h* may be irradiated with a main pulsed laser light beam with an elongated circular shape as illustrated in FIG. 25, the CE can be improved.

Figure 27:
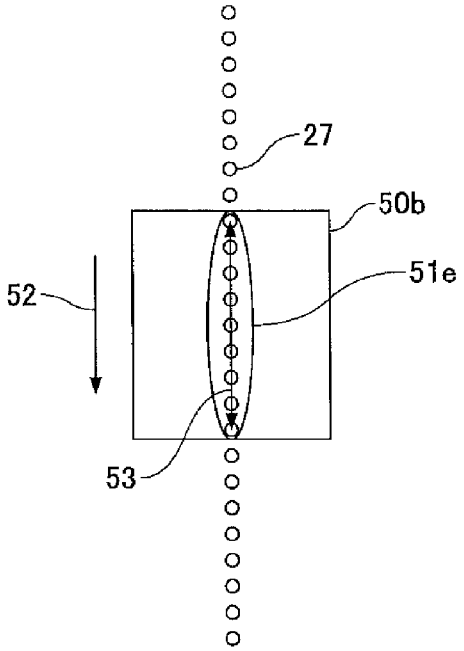
FIG. 27 is a diagram illustrating a focused light beam of linearly polarized pre-pulsed laser light having an elongated-circular-shaped beam spot with a longitudinal axis in a traveling direction of a plurality of droplets and a focused light beam of main pulsed laser light having a beam spot of a rectangular-shaped focused light beam.
Figure 28:
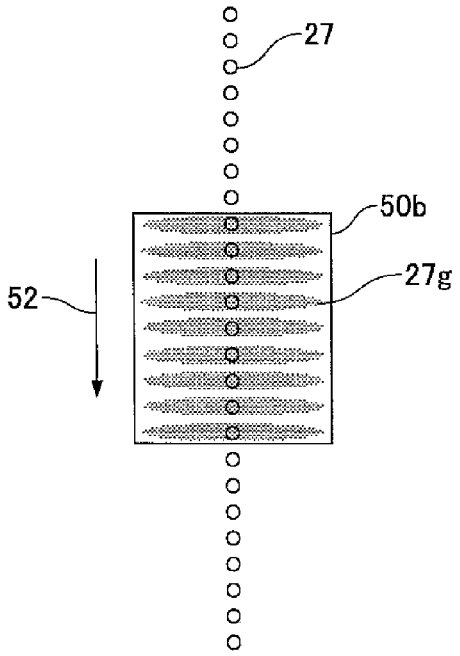
FIG. 28 is a diagram illustrating a target substance diffused after a plurality of droplets are irradiated with pre-pulsed laser light.
Figure 29:
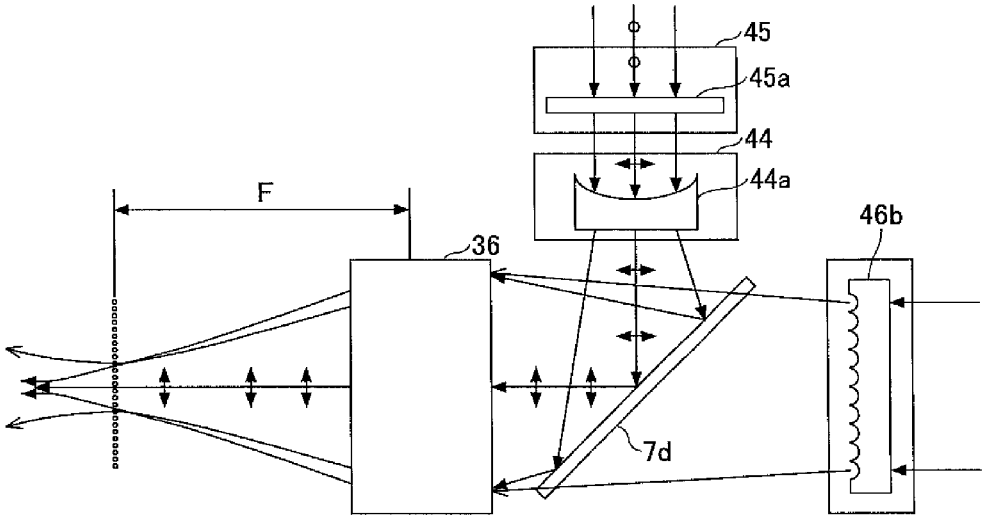
FIG. 29 is a diagram illustrating an optical system for irradiating droplets with pre-pulsed laser light and main pulsed laser light as illustrated in FIG. 27.

FIGS. 27 to 29 illustrate an embodiment in a case where a focused light beam of main pulsed laser light has a generally rectangular shape.

FIG. 27 illustrates a pre-pulsed laser light beam with linear polarization that is a focused light beam 51*e* with an elongated circular shape having a longitudinal axis in a traveling direction of a plurality of droplets 27. FIG. 27 illustrates both a focused light beam 51*e* of pre-pulsed laser light and a focused light beam 50*b* of main pulsed laser light. However, in practice, droplets 27 are irradiated with pre-pulsed laser light and subsequently irradiated with main pulsed laser light. The purpose of illustrating both of them is to illustrate a relationship of diameters and light focusing positions between the focused light beam 51*e* of pre-pulsed laser light and the focused light beam 50*b* of main pulsed laser light.

FIG. 28 illustrates a schematic diagram of diffused targets 27*g* after a plurality of droplets 27 are irradiated with pre-pulsed laser light and main pulsed laser light 50*b* that is a focused light beam with a generally rectangular shape for irradiating the diffused targets.

FIG. 29 illustrates an optical system for conducting irradiation illustrated in FIGS. 27 and 28.

The optical system illustrated in FIG. 29 is generally identical to the optical system illustrated in FIG. 23. However, the optical system illustrated in FIG. 29 is different from the embodiment illustrated in FIG. 23 in that a beam shaping unit 46 (micro-fly-eye lens 46*b*) is placed on an optical path between a main pulsed laser device and a dichroic mirror.

Such a micro-fly-eye lens may be an optical element processed in such a manner that a plurality (several hundred or more) of concave lenses with a rectangular shape (that is a similarity shape with that of a focused light beam of main pulsed laser light in FIG. 28) are provided on a substrate to provide rectangular focused light beams.

A pre-pulsed laser light beam may be divided into a plurality of beams by the micro-fly-eye lens and the plurality of divided beams may be expanded by respective lenses. Then, the plurality of beams expanded by respective lenses can be incident on and highly transmit through a dichroic mirror 7*d* and then overlapped by a laser light focusing optical system 36 at a position of a focal point to provide a beam with a rectangular shape (Koehler illumination).

Pre-pulsed laser light may transmit through a $\lambda/2$ plate 45*a* in such a manner that a direction of polarization thereof is rotated by 90° to provide a polarization direction that is a direction parallel to the plane of paper. A target having a form of a plurality of droplets 27 can principally be diffused in a direction orthogonal to a polarization direction by irradiation with pre-pulsed laser light with linear polarization.

Such a diffused target can be irradiated with main pulsed laser light with a rectangular shape 50*b* to produce plasma and thereby generate EUV light.

Since a diffused target can be irradiated with a main pulsed laser light beam that is a focused light beam with a rectangular shape corresponding to the diffused target as illustrated in FIG. 28, the CE can be improved.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more".

What is claimed is:

1. An extreme ultraviolet light generation apparatus, comprising:

a droplet production device configured to produce a droplet of a target substance in a predetermined traveling direction;

a first laser device configured to generate a first laser beam and irradiate the droplet with the first laser beam to diffuse the droplet;

a second laser device configured to generate a second laser beam and irradiate the target substance diffused by irradiation of the first laser beam with the second laser beam to produce plasma of the diffused target substance and generate extreme ultraviolet light from the plasma of the target substance;

a beam shaping unit configured to elongate a beam spot of the first laser beam in the traveling direction of the droplet produced by the droplet production device; and a polarization adjustment mechanism configured to adjust polarization of the first laser beam emitted from the first laser device, wherein the polarization of the first laser beam adjusted by the polarization adjustment mechanism is linear polarization and a polarization direction of the linear polarization is generally parallel to the traveling direction of the droplet.

2. The extreme ultraviolet light generation apparatus as claimed in claim 1, wherein a plurality of the droplets are present in the beam spot of the first laser beam.

3. The extreme ultraviolet light generation apparatus as claimed in claim 1, further comprising:

another beam shaping unit configured to shape a beam spot of the second laser beam into a rectangular shape.

4. An extreme ultraviolet light generation apparatus, comprising:

a droplet production device configured to produce a droplet of a target substance in a predetermined traveling direction;

a first laser device configured to generate a first laser beam and irradiate the droplet with the first laser beam to diffuse the droplet;

a second laser device configured to generate a second laser beam and irradiate the target substance diffused by irradiation of the first laser beam with the second laser beam to produce plasma of the diffused target substance and generate extreme ultraviolet light from the plasma of the target substance;

a beam shaping unit configured to elongate a beam spot of the first laser beam in the traveling direction of the droplet produced by the droplet production device; and a polarization adjustment mechanism configured to adjust polarization of the first laser beam emitted from the first laser device, wherein the polarization of the first laser beam adjusted by the polarization adjustment mechanism is elliptical polarization and a direction of a longitudinal axis of the elliptical polarization is generally parallel to the traveling direction of the droplet.

5. An extreme ultraviolet light generation method, comprising:

producing a droplet of a target substance in a predetermined traveling direction;

generating a first laser beam;

adjusting polarization of the first laser beam;

shaping a beam spot of the first laser beam to be elongated in the traveling direction of the droplet;

irradiating the droplet with the first laser beam to diffuse the droplet;

generating a second laser beam; and irradiating the target substance diffused by irradiation of the first laser beam with the second laser beam to produce plasma of the diffused target substance and generate extreme ultraviolet light from the plasma of the target substance, wherein the polarization of the first laser beam adjusted by adjusting the polarization is linear polarization and a polarization direction of the linear polarization is generally parallel to the traveling direction of the droplet.

6. The extreme ultraviolet light generation method as claimed in claim 5, wherein a plurality of the droplets are present in the beam spot of the first laser beam.

7. The extreme ultraviolet light generation method as claimed in claim 5, further comprising:

shaping a beam spot of the second laser beam into a rectangular shape.

8. An extreme ultraviolet light generation method, comprising:

producing a droplet of a target substance in a predetermined traveling direction;

generating a first laser beam;

adjusting polarization of the first laser beam;

shaping a beam spot of the first laser beam to be elongated in the traveling direction of the droplet;

irradiating the droplet with the first laser beam to diffuse the droplet;

generating a second laser beam; and irradiating the target substance diffused by irradiation of the first laser beam with the second laser beam to produce plasma of the diffused target substance and generate extreme ultraviolet light from the plasma of the target substance, wherein the polarization of the first laser beam adjusted by adjusting the polarization is elliptical polarization and a direction of a longitudinal axis of the elliptical polarization is generally parallel to the traveling direction of the droplet.

* * * * *